United States Patent [19]

Miller

[11] Patent Number: 4,944,203

[45] Date of Patent: Jul. 31, 1990

[54] DRYWALL HAMMER AND MAGNETIC HANDLE

[76] Inventor: John A. Miller, Rt. #1, Box 1315, Quinton, Va. 23141

[21] Appl. No.: 413,222

[22] Filed: Sep. 27, 1989

[51] Int. Cl.[5] ..... B25D 1/04

[52] U.S. Cl. ..... 81/24

[58] Field of Search ..... 81/20, 23, 24, 25; 7/901

[56] References Cited

U.S. PATENT DOCUMENTS

| | | | |
|---|---|---|---|
| 294,144 | 2/1884 | Pace | 81/20 X |
| 1,822,280 | 9/1931 | Ervay | 81/20 X |
| 2,788,815 | 4/1957 | D'Aoust | 81/24 |
| 2,804,109 | 8/1957 | Fatica | 81/20 X |
| 3,228,720 | 1/1966 | Jordan | 81/24 |
| 3,580,312 | 5/1971 | Hallock | 81/24 |
| 3,763,906 | 10/1973 | Crowder | 81/24 |
| 4,520,997 | 6/1985 | Lorton, Sr. | 81/24 X |
| 4,753,138 | 6/1988 | Soucy | 81/24 |

*Primary Examiner*—D. S. Meislin

*Attorney, Agent, or Firm*—Leon Gilden

[57] ABSTRACT

A drywall hammer utilizing a beveled first end and a blunt second end formed on the head of the hammer is provided at an angulation relative to the axis of the handle to protect an individual's hand when utilizing the hammer. Furthermore, the handle is provided with a magnetic member directed through the handle oriented orthogonally relative to the axis of the handle to position nails and the like thereon for use by an individual to enable positioning of nails within a drywall surface at elevated positions to provide enhanced access by an individual without recourse to ladders and the like.

4 Claims, 5 Drawing Sheets

PRIOR ART

Fig 5
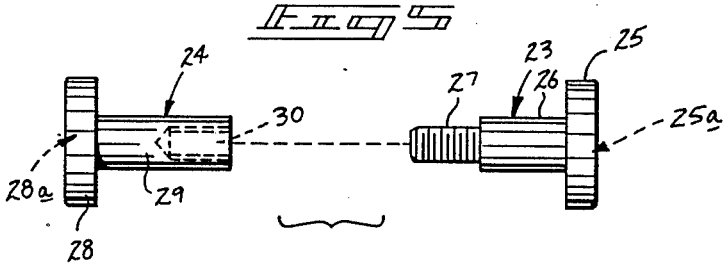
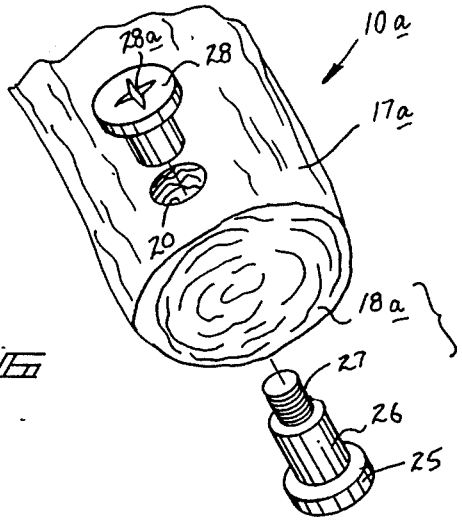
Fig 6
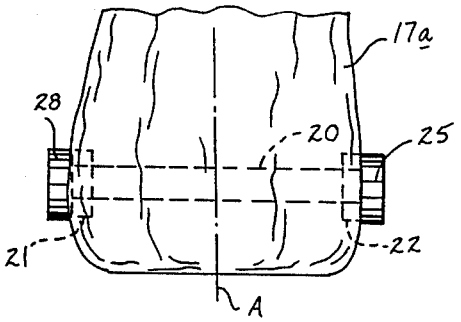
Fig 7

DRYWALL HAMMER AND MAGNETIC HANDLE

BACKGROUND OF THE INVENTION

1. Field of the Invention

The field of invention relates to drywall hammers, and more particularly pertains to a new and improved drywall hammer and magnetic handle wherein the magnetic member of the hammer is arranged orthogonally relative to the axis of the handle to enable positioning of nails within the drywall at elevated positions.

2. Description of the Prior Art

The prior art has utilized and provided hammers in various shapes and configurations to address particular problems. The use of magnetic inserts within a hammer has been utilized in the prior art for purposes such as supporting nails prior to their use for convenience on the handle of the hammer, as opposed to the instant invention utilizing the inserted magnet orthogonally aligned relative to the axis of the handle for positioning of a nail aligned with the magnet into an associated wall, whereupon an individual may position the nail without recourse to elevation assisting devices such as step ladders, boxes, and the like. Examples of the prior art include U.S. Pat. No. 3,763,906 to Crowder utilizing a provision of through-extending apertures for storage of nails and the like within the hammer handle set forth by the patent.

U.S. Pat. No. 3,228,720 to Jordan sets forth a magnetic device coaxially aligned to the axis of the handle for storage of nails thereon prior to their use.

U.S. Pat. No. 4,753,138 to Soucy provides a handle cap formed with a cavity to receive a tool handle therewithin. The cap includes an elongate magnet positioned therewithin for alignment of oversized nails therewithin. The cap, however, of the Soucy patent and the associated cap in its protrusion exteriorly of the surface of the handle provides interference in use of the handle by an individual in the repetitive need for repositioning of an individual's hand on the handle portion and interference with the cap thereby.

U.S. Pat. No. 3,580,312 to Hallock sets forth a hammer provided with an orthogonally oriented head relative to a handle, wherein the head includes a plurality of magnets positioned therewithin as part of the striking face of the hammer.

U.S. Pat. No. 2,788,815 to D'Aoust sets forth a hammer with a magnetic nail placer formed through the head of the handle orthogonally aligned relative to the hammer head.

As such, it may be appreciated that there is a continuing need for a new and improved drywall hammer and magnetic handle wherein the same addresses both the features of ease of use and convenience in construction, and in this respect, the present invention substantially fulfills this need.

SUMMARY OF THE INVENTION

In view of the foregoing disadvantages inherent in the known types of magnetic hammer handles now present in the prior art, the present invention provides a drywall hammer and magnetic handle wherein the same utilizes an elongate permanent magnet directed orthogonally relative to the axis of the handle adjacent a lowermost end thereof. As such, the general purpose of the present invention, which will be described subsequently in greater detail, is to provide a new and improved drywall handle and magnetic handle which has all the advantages of the prior art hammers including magnetic adjuncts associated therewith and none of the disadvantages.

To attain this, the present invention includes a hammer formed with a metallic head, wherein the head is inclined approximately five to twenty degrees relative to the elongate axis of the handle to afford protection of an individual's hand positioned on the handle, and additionally sets forth a magnet orthogonally directed through the axis of the handle positioned adjacent the lowermost end of the handle. The magnet may be of a single through-extending construction or may alternatively include a multi-part magnet insertable through a through-extending bore formed with cross slots therewithin to enhance securement of the magnet within the handle and further provide a positioning recess for a nail positioned within the slotted recess.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drywall hammer and magnetic handle which has all the advantages of the prior art magnetic handles and none of the disadvantages.

It is another object of the present invention to provide a new and improved drywall hammer and magnetic handle which may be easily and efficiently manufactured and marketed.

It is a further object of the present invention to provide a new and improved drywall hammer and magnetic handle which is of a durable and reliable construction.

An even further object of the present invention is to provide a new and improved drywall hammer and magnetic handle which is susceptible of a low cost of manufacture with regard to both materials and labor, and which accordingly is then susceptible of low prices of sale to the consuming public, thereby making such drywall hammer and magnetic handles economically available to the buying public.

Still yet another object of the present invention is to provide a new and improved drywall hammer and magnetic handle which provides in the apparatuses and methods of the prior art some of the advantages thereof, while simultaneously overcoming some of the disadvantages normally associated therewith.

Still another object of the present invention is to provide a new and improved drywall hammer and magnetic handle wherein the same provides a magnet directed orthogonally through a lowermost end of the handle orthogonally relative to the axis of the handle to permit positioning of nails prior to their being directed interiorly of the wall by the associated head of the hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic side view taken in elevation of the instant invention.

FIG. 5 is an orthographic view of a modified magnet utilized by the instant invention.

FIG. 6 is an isometric illustration of the modified magnet of FIG. 5 positioned relative to the handle.

FIG. 7 is an orthographic view taken in elevation of the magnet of FIG. 5 secured within the handle of the instant invention.

DESCRIPTION OF THE PREFERRED EMBODIMENT

Figure 1:
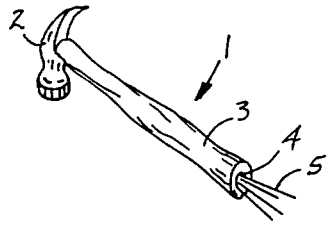
FIG. 1 is an isometric illustration of the prior art.

With reference now to the drawings, and in particular to FIGS. 1 to 8 thereof, a new and improved drywall hammer and magnetic handle embodying the principles and concepts of the present invention and generally designated by the reference numerals 10 and 10*a* will be described.

Figure 2:
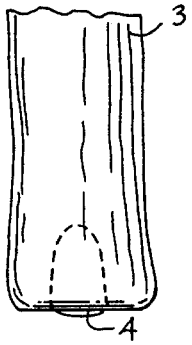
PRIOR ART Fig 2
FIG. 2 is an orthographic view taken in elevation, somewhat enlarged, of the lowermost portion of the handle, as illustrated in FIG. 1.

More specifically, the drywall hammer and magnetic handle 10 defines an improvement over the prior art, as typified by FIGS. 1 and 2, wherein a prior hammer 1 includes an enlarged metallic head 2 with an orthogonally positioned handle 3. A magnet 4 is positioned coaxially with a handle 3 to support nails 5 prior to their use.

Figure 3:
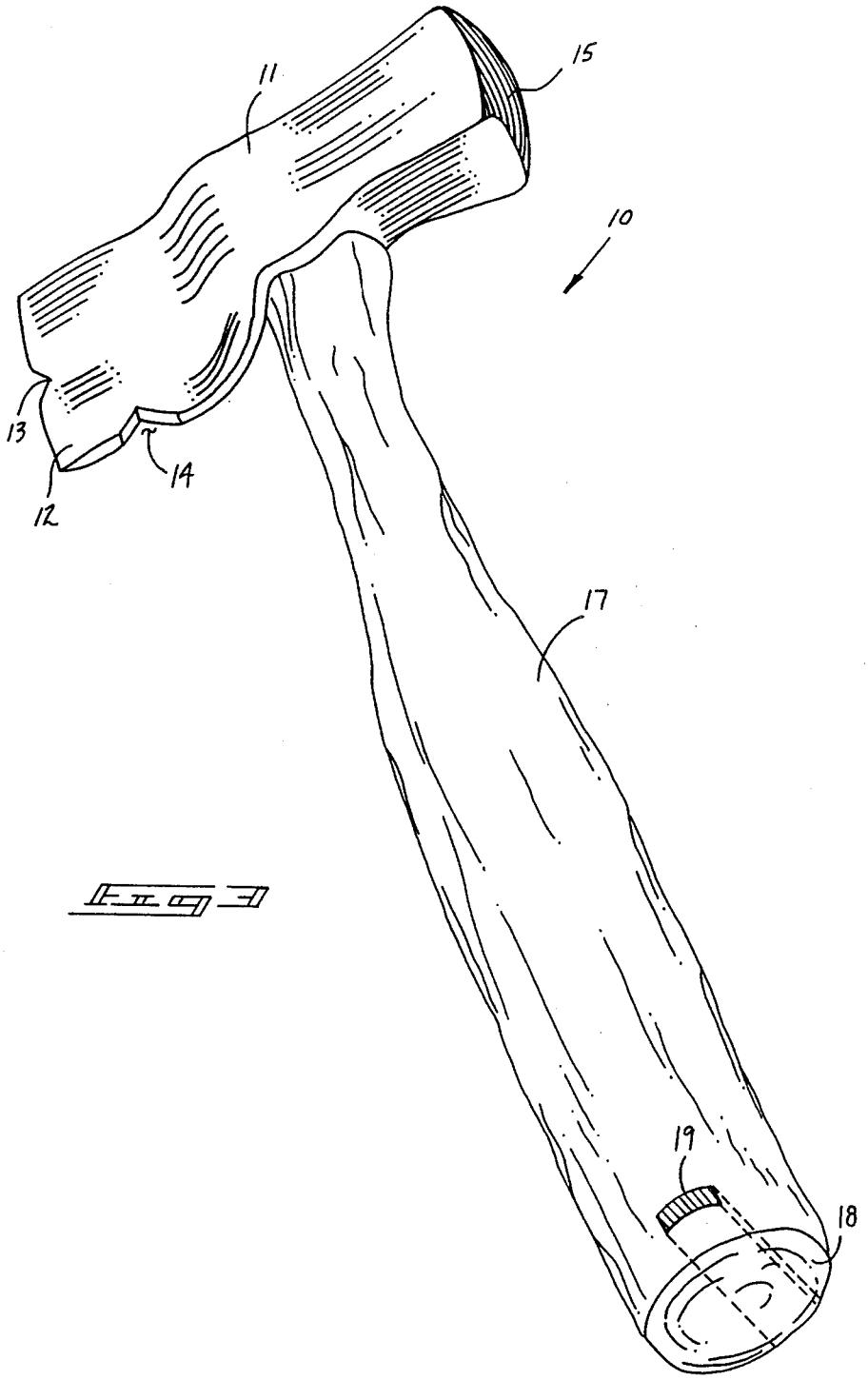
FIG. 3 is an isometric illustration of the instant invention.
Figure 2:
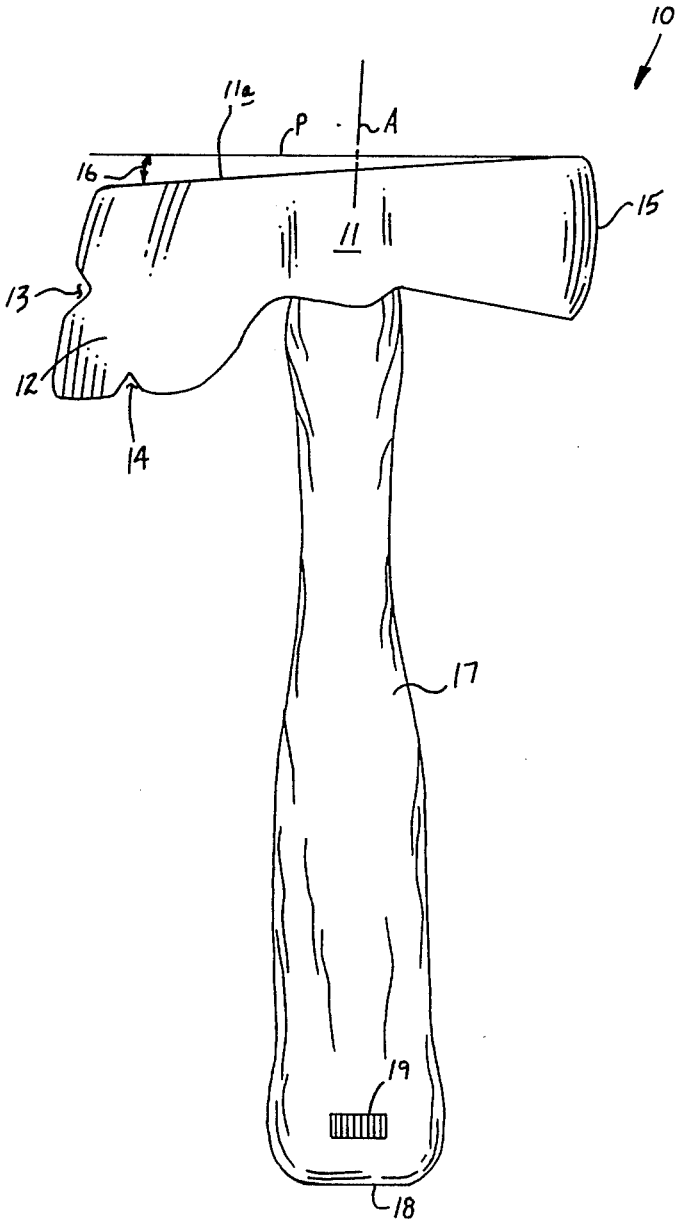

The drywall hammer and magnetic handle 10, as illustrated in FIG. 3 for example, includes a metallic head portion 11 including a beveled first end including beveled side wall faces, wherein a first notch recess 13 is positioned longitudinally aligned with the head portion 11 with a second notch recess 14 positioned orthogonally relative to the longitudinal head portion 11, wherein the first and second notch recesses 13 and 14 are arranged for nail or screw receiving notches to enable removal of such nails and screws as desired by an individual. The head portion 11 includes a blunt second end 15 aligned with the beveled first end 12 for use as a striking head of the hammer. As illustrated in FIG. 4, the head portion 11 is inclined relative to the elongate axis of the handle 17 by an arc between five and fifteen degrees, or conventionally, $\frac{3}{8}$ inch between the top surface 11*a* of the head 11 in a plane "P" aligned perpendicular to the axis "A" of the elongate handle 17, as illustrated in FIG. 4. The inclination of the head 11, as illustrated in FIG. 4, affords a degree of protection to an individual's fingers when secured about the handle in use.

The elongate handle 17 is defined by an arcuate exterior surface symmetrically arranged about the elongate axis "A" and formed with a blunt lower terminal end 18 arranged orthogonally relative to the axis "A". An elongate magnet 19 is arranged orthogonally relative to the axis "A" adjacent the lower terminal end 18 extending through the handle 17 of a single unitary construction and formed with an exterior face of complementary configuration to that defined by the arcuate exterior surface of the handle 17.

Figure 8:
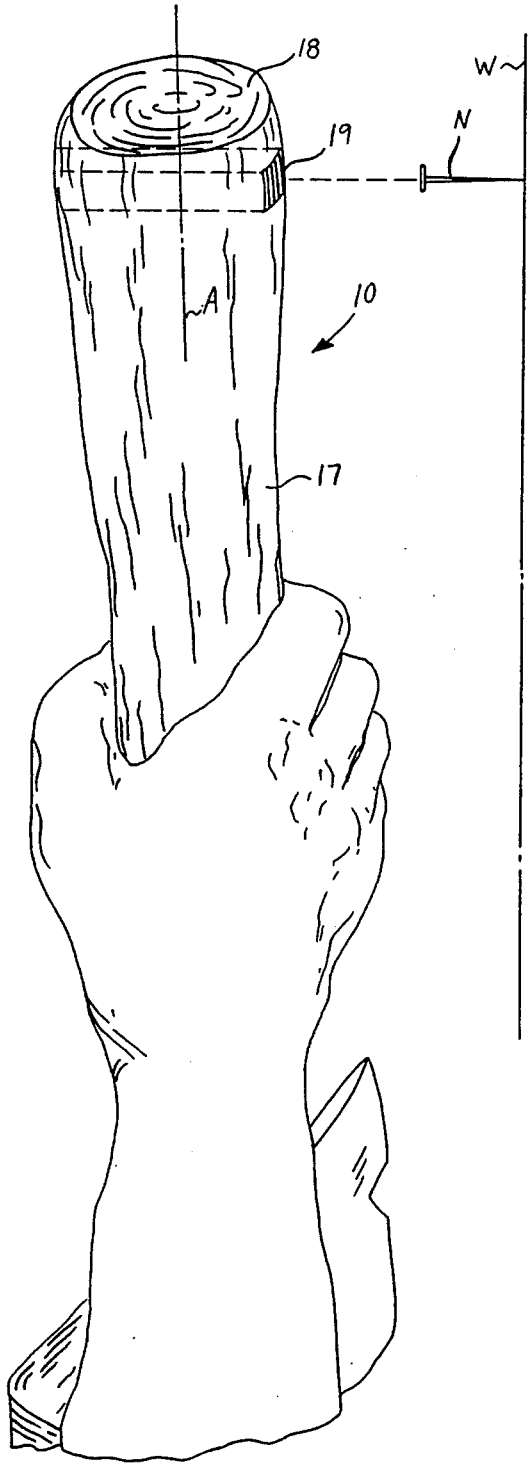
FIG. 8 is an isometric illustration of the instant invention in use.

FIG. 8 is illustrative of the drywall hammer and magnetic handle 10 in use, wherein a nail "N" is pre-positioned in longitudinal alignment with the elongate axis of the permanent magnet 19 to enable positioning of the nail "N" to an overlying position relative to an individual orthogonally into a wall surface "W". Subsequently, the nail "N" as positioned is subject to being driven within the wall "W" by the individual positioned therebelow without recourse to ladders and the like.

FIGS. 5 through 7 are illustrative of a modified drywall hammer and magnetic handle 10*a* wherein the modified handle 17*a* includes a through-extending bore 20 of cylindrical configuration positioned parallel to the lower terminal end 18*a* to receive a two-part magnet therewithin. The two-part magnet includes a first magnetic member 23 and a second magnetic member 24 securable together interiorly of the bore 20 when inserted therewithin. The magnetic members may be positioned, as illustrated in FIG. 7, to extend exteriorly of the exterior surface of the handle 17*a* or be positioned within complementary cylindrical recesses defined by a first cylindrical recess 21 and a second cylindrical recess 22 of a configuration complementary to that of the respective first and second head members 25 and 28 of the respective first and second magnetic members 23 and 24. The first magnetic head members 25 and 26 are each of a first diameter with planar exterior faces formed with respective first and second cross slotted recesses 25*a* and 28*a* to enable reception of a Phillips head screw driver to enhance their securement interiorly of the bore 20 and further define a recess for positioning of a nail "N" therewithin for subsequent use, as illustrated in FIG. 8, wherein the recesses 25*a* and 28*a* each enable a nail to be anchored within the recess for enhanced stability for positioning within the wall "W", as illustrated in FIG. 8.

The first magnetic member 23 is formed with a first shank 26 of a first diameter equal to that of the bore 20, where in a similar manner the second magnetic member 24 is formed with a second shank 29, also of the first diameter. The first shank 26 includes an axially aligned threaded shank 27 of a reduced second diameter receivable within internally threaded bore 30 of the second diameter to enable a flush fitting of the first and second magnetic members 28 and 24 in an aligned relationship within the bore 20, as illustrated in FIG. 7. The thusly aligned magnetic members 23 and 24 join together to define a unitary single permanent magnet and also aligned orthogonally relative to the axis "A" of the handle 17*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A drywall hammer comprising an elongate metallic head member including a first beveled end terminating in an elongate edge, and a second blunt end aligned with the first end, and an elongate handle fixedly mounted to the head member symmetrically defined about a handle axis, the handle including a lowermost handle end defined by a first plane orthogonally aligned to the handle axis, and an elongate permanent magnet member extending through the handle adjacent the handle end orthogonally aligned relative to the handle axis, and wherein the handle includes an arcuate exterior surface, and each end of the elongate magnet extending through the handle is defined by an arcuate surface complementary to that defined by the handle, and wherein the head member is defined by a top planar surface, the top planar surface canted at an angle between five and fifteen degrees relative to a second plane, the second plane aligned orthogonally relative to the handle axis, and wherein the elongate edge of the beveled edge of the beveled end of the head member includes a first notch, and a second notch directed interiorly of a bottom surface of the head member adjacent the elongate edge oriented orthogonally relative to the first notch, and wherein the magnet member includes a first and second magnet, the first magnet includes a first cylindrical head member, and the second magnet includes a second cylindrical head member, the first head member is orthogonally mounted to and coaxially aligned with a first shank of a first diameter, and a threaded shank of a reduced second diameter coaxially aligned with the first shank integrally formed to the first shank of the first magnet, and the second head member including a second shank of a first diameter and formed with an integrally threaded bore to receive the threaded shank of the first magnet, and a bore defined by the first diameter directed orthogonally relative to the axis of the handle through the handle and adjacent the handle end.

2. A drywall hammer as set forth in claim 1 wherein the first head and the second head are formed with a coaxially aligned, crossed slotted portion for receiving a nail in alignment therewithin.

3. A drywall hammer as set forth in claim 2 wherein the bore includes a first and second cylindrical recess coaxially aligned with the bore at opposite ends thereof to receive the first head and second head respectively in a complementary manner therewithin.

4. A drywall hammer as set forth in claim 3 wherein the first beveled end is spaced $\frac{3}{8}$ inch below the second plane.

* * * * *